US009340944B2

(12) United States Patent
Kahlman

(10) Patent No.: US 9,340,944 B2
(45) Date of Patent: May 17, 2016

(54) DEVICE FOR A PILE, WHICH CAN BE ANCHORED IN THE BOTTOM OF A LAKE OR THE SEA AND/OR THE GROUND

(71) Applicant: Sture Kahlman, Fjällbacka (SE)

(72) Inventor: Sture Kahlman, Fjällbacka (SE)

( * ) Notice: Subject to any disclaimer, the term of this patent is extended or adjusted under 35 U.S.C. 154(b) by 0 days.

(21) Appl. No.: 14/372,034

(22) PCT Filed: Jan. 21, 2013

(86) PCT No.: PCT/SE2013/050033

§ 371 (c)(1),
(2) Date: Jul. 14, 2014

(87) PCT Pub. No.: WO2013/109186

PCT Pub. Date: Jul. 25, 2013

(65) Prior Publication Data

US 2015/0050090 A1 Feb. 19, 2015

(30) Foreign Application Priority Data

Jan. 19, 2012 (SE) ..... 1250028

(51) Int. Cl.
*E02D 5/54* (2006.01)
*E02D 5/56* (2006.01)
*E02D 5/22* (2006.01)

(52) U.S. Cl.
CPC .. *E02D 5/56* (2013.01); *E02D 5/22* (2013.01); *E02D 5/223* (2013.01); *E02D 5/54* (2013.01)

(58) Field of Classification Search
CPC ..... E02D 5/54; E02D 5/56; E02D 5/60; E02D 5/801
USPC ..... 405/218–221, 224, 224.1, 226, 228, 405/231, 244, 252.1, 253
See application file for complete search history.

(56) References Cited

U.S. PATENT DOCUMENTS 2,141,106 A * 12/1938 Greulich ..... 405/233
2,846,852 A * 8/1958 Cappel ..... 405/231

(Continued)

FOREIGN PATENT DOCUMENTS

EP 0312198 A1 4/1989
GB 15788 * 5/1912

(Continued)

OTHER PUBLICATIONS

Sweden Patent Office, Int'l Search Report in PCT/SE2013/050033, Apr. 22, 2013.

*Primary Examiner* — Frederick L Lagman
(74) *Attorney, Agent, or Firm* — Piedmont Intellectual Property

(57) ABSTRACT

A device for a pile anchorable in the bottom of a lake or sea and/or in the ground and of the screw- and/or push-type. The device includes a force-transmitting part arranged at an upper portion of a front tubular part of the pile. The force-transmitting part includes either a disk-shaped part with a substantially vertically extending flange directed toward the front tubular part, or a threaded portion along the pile that includes at least approximately one turn around and a cylinder-shaped part extending in a longitudinal direction of the threaded portion and completely around the threaded portion. The front tubular part includes apertures for debouching water and air from the upper portion. The force-transmitting part enables transmitting downwardly directed axial forces and laterally directed horizontal forces to the bottom or ground.

11 Claims, 12 Drawing Sheets

(56) References Cited

U.S. PATENT DOCUMENTS

Figure 2:
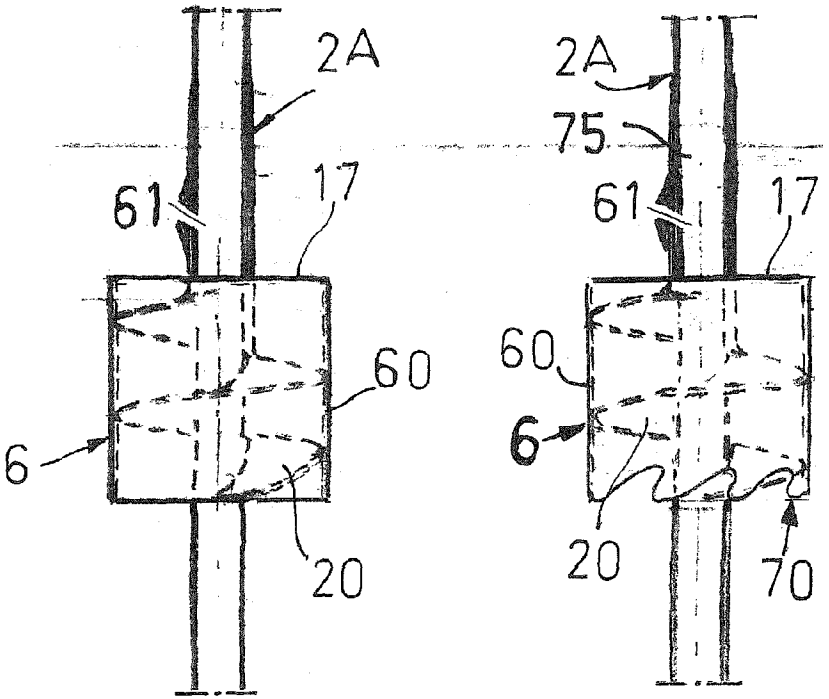

| | | | | | |
|---|---|---|---|---|---|
| 3,628,337 | A * | 12/1971 | Stepanich et al. | 405/253 |
| 3,703,812 | A * | 11/1972 | Newton | 405/244 |
| 4,212,564 | A * | 7/1980 | Kay | 405/218 |
| 4,239,419 | A * | 12/1980 | Gillen, Jr. | 405/232 |
| 4,650,372 | A * | 3/1987 | Gorrell | 405/232 |
| 4,938,629 | A * | 7/1990 | Boudrias | 405/205 |
| 6,272,798 | B1 | 8/2001 | Cockman | |
| 7,004,683 | B1 * | 2/2006 | Rupiper | 405/229 |
| 7,407,342 | B2 * | 8/2008 | Seidel | 405/224.1 |
| 2003/0029620 | A1 * | 2/2003 | Strand | 166/367 |
| 2004/0115008 | A1 * | 6/2004 | Merjan et al. | 405/253 |
| 2007/0028533 | A1 | 2/2007 | Stroyer | |
| 2007/0248420 | A1 * | 10/2007 | Jacobs et al. | 405/218 |

FOREIGN PATENT DOCUMENTS

| | | | |
|---|---|---|---|
| SE | 506995 | C2 | 12/1997 |
| WO | 2004/020743 | A1 | 3/2004 |
| WO | 2004/040069 | A1 | 5/2004 |

* cited by examiner

DEVICE FOR A PILE, WHICH CAN BE ANCHORED IN THE BOTTOM OF A LAKE OR THE SEA AND/OR THE GROUND

The present invention relates to a device for a pile, which can be anchored in the bottom of a lake or the sea and/or the ground, which is of the screw and/or the push type and which exhibits at least a front part, but preferably also an intermediate part and an upper part, and which pile consists of plastic, concrete, and/or steel material.

Piles for building up bridges and which are used as mooring piles in a wet environment, where woodworm infestation, ice and other rough environment, for example caused by wind and weather, have a negative effect on the piles, are a great financial problem, but also a considerable safety problem when using wooden piles, or other types of piles, which are negatively influenced thereby.

In order to protect the environment it is not suitable to impregnate the piles with toxic substances against infestation by vermin.

Furthermore, there is problematic to avoid to damage the bottom segment when piles are driven into the bedding, for example the bottom of a lake or any other ground, where the piles are to be used for various purposes, and also to enable the piles to absorb various stresses caused by various vertical and horizontal forces.

Examples of screw piles, which can be anchored in the bottom of the sea, are disclosed in for instance WO 2004/040069A1 and US 2007/0028533 A1, but none of these screw piles or other known screw piles exhibit a portion, which is designed to make possible the transmission both of axial forces and horizontal forces to the bottom, or which can be pushed or screwed into the bottom and/or other ground.

By U.S. Pat. No. 6,272,798 B1 a device is previously known, which relates to a homogeneous screw pile with a disc-shaped part, which is pivotally mounted on the pile and which can be pushed into the ground. When an obliquely directed force acts on the upper part of the pile, the part which can be pushed down is pivoted and pushed into the material of the bottom and stabilizes the pile.

By WO 2004/020743 A1 a device is previously known, which relates to a divided anchoring pile with an anchoring part, which first can be screwed into the ground, and a fastening part, which after anchoring of the anchoring part can be mounted thereon. The anchoring part is not tubular, but exhibits a point, and both of the parts coupled together with one another are so arranged, that after the assembling their lengths can be telescopically changed by means of a nut and a threaded rod received therein.

The function of said known solutions is that the driving down of the force transmitting part is effected by means of a thread in the front of the pile. This means that when the resisting force exceeds the driving force downwardly, a "drilling effect" at the thread arises and the ground material is damaged, which deteriorates the stabilizing and retaining of the pile in said ground material.

The main object of the present invention is therefore, among other things, to solve at least the above described problem, but also a number of further not mentioned problems, in a simple and efficient way.

It is also desirable to be able to produce piles in a financially advantageous way, which are to be re-usable, easy to handle and to transport.

Said objects are reached by means of a device according to the present invention, which is mainly characterized in that at the upper portion of the front part a power transmitting part is arranged, which is formed of a substantially horizontal or inclined, disc-shaped, stationary or rotatable part with substantially vertically extending flange, which is directed towards said front part, preferably at the peripheral edge of the disc-shaped part, or that the power transmitting part is formed of a portion of a thread along the pile, approximately one turn round the pile, and with a cylinder-shaped part extending in the longitudinal direction of said thread and completely round said thread, that the front part of the pile is tubular, whereby a number of evacuation apertures for water and air debouch from the upper portion of the front part into the surroundings, and which power transmitting part is designed to make it possible to transmit downwards directed axial forces and laterally directed horizontal forces to the bottom or ground segment in question.

The current problem is not the driving down itself, since you obtain considerable forces by means of hydraulic excavators, but the problem is, as mentioned above, that the bottom segment is destroyed, whereby the load transmitting capacity is deteriorated when the piles are driven into the bottom material. Homogeneous bottom segment is a condition of obtaining a screwing effect and avoiding the drilling effect when the pile is driven down.

The solution of said problems is among other things to make an aperture for the evacuation of water and air from the inner space of the tubular pile. Thereby, the bottom segment in the driving part can be conveyed upwards without being destroyed. There will be no destruction at the point of the pile. This means that less force is required for the driving down and that the amount of destroyed segment will be smaller and, consequently, the pile will have better and faster load absorbing capacity. The front part is designed to drive the pile into the ground and anchor it against axial forces directed upwards caused for example by ice and anchoring forces. The piles may be reinforced on the exterior with glass fibre reinforcement and gel coat on the outside.

Furthermore, said aperture also functions to evacuate the inner space of the pile, i.e. as evacuation aperture in order to bring about reduction of pressure in case of ice formation inside the pile, and thereby eliminate the risk of blasting of the tubular pile.

Figure 1:
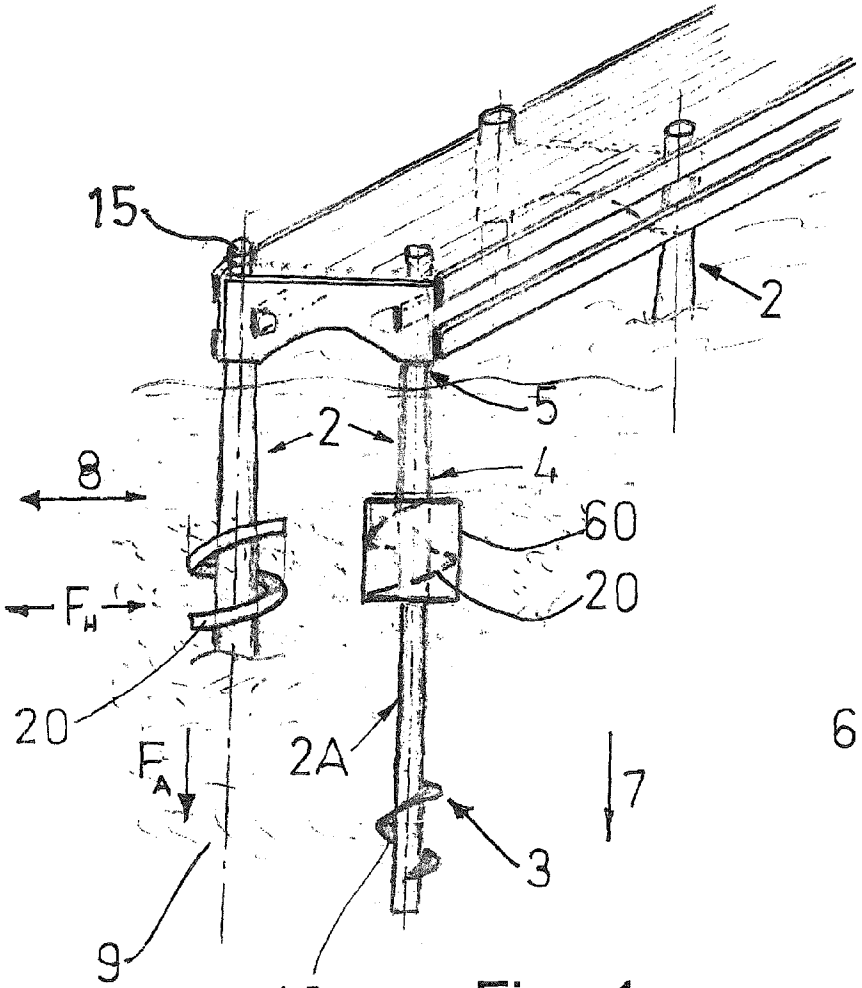
Figure 3:
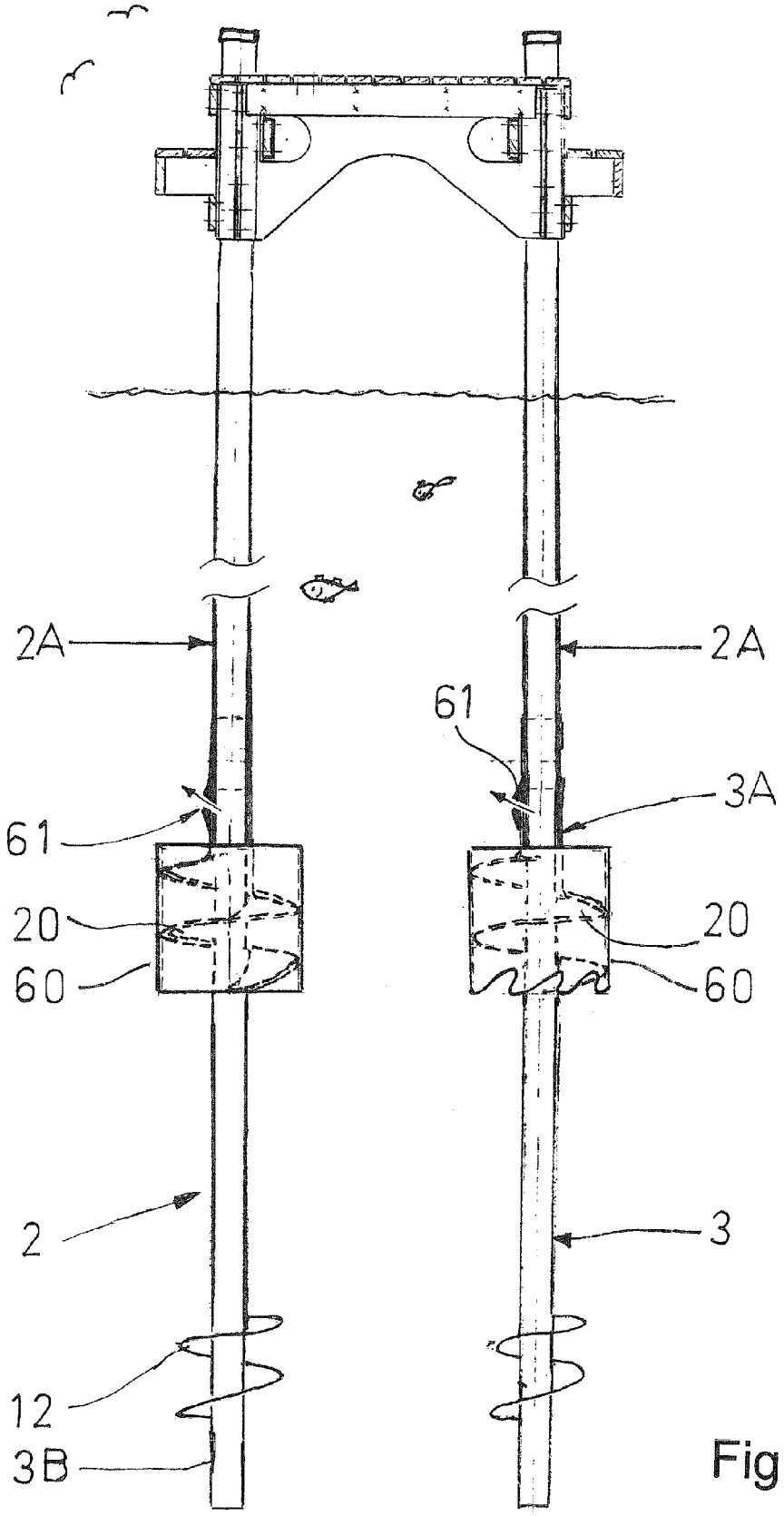
Figure 4:
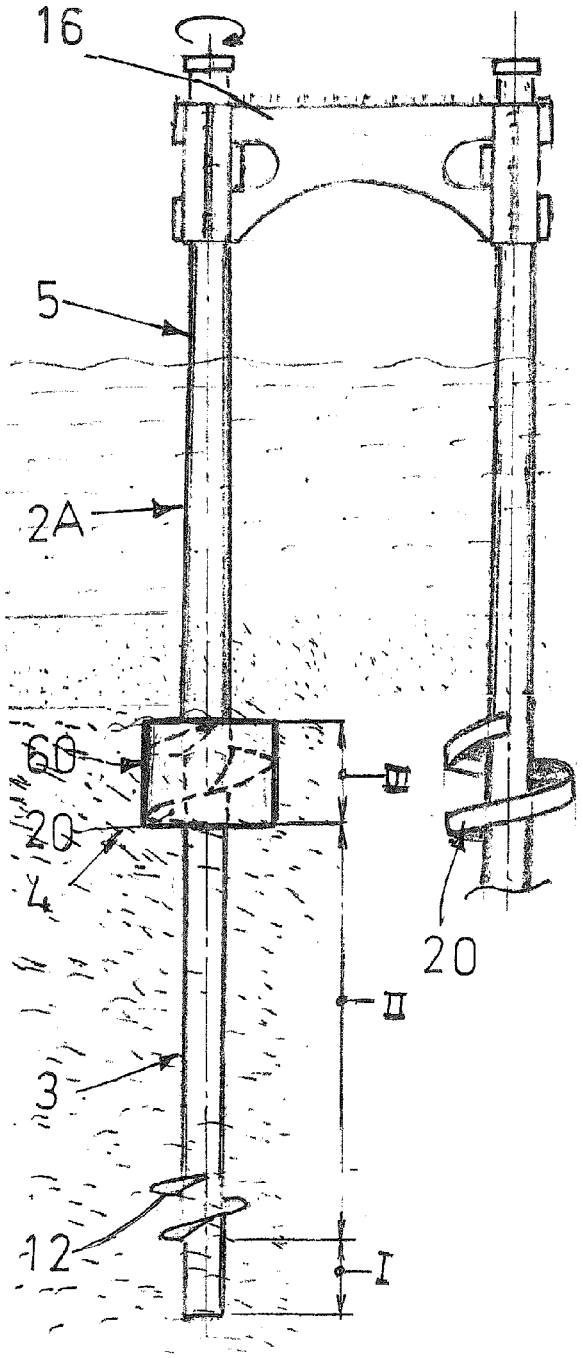
Figure 5:
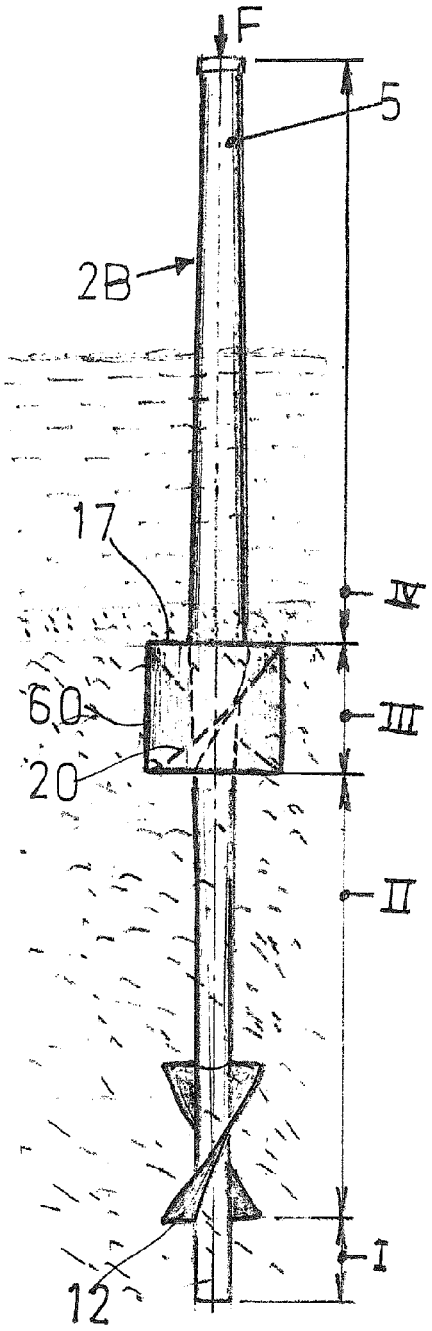
Figure 6:
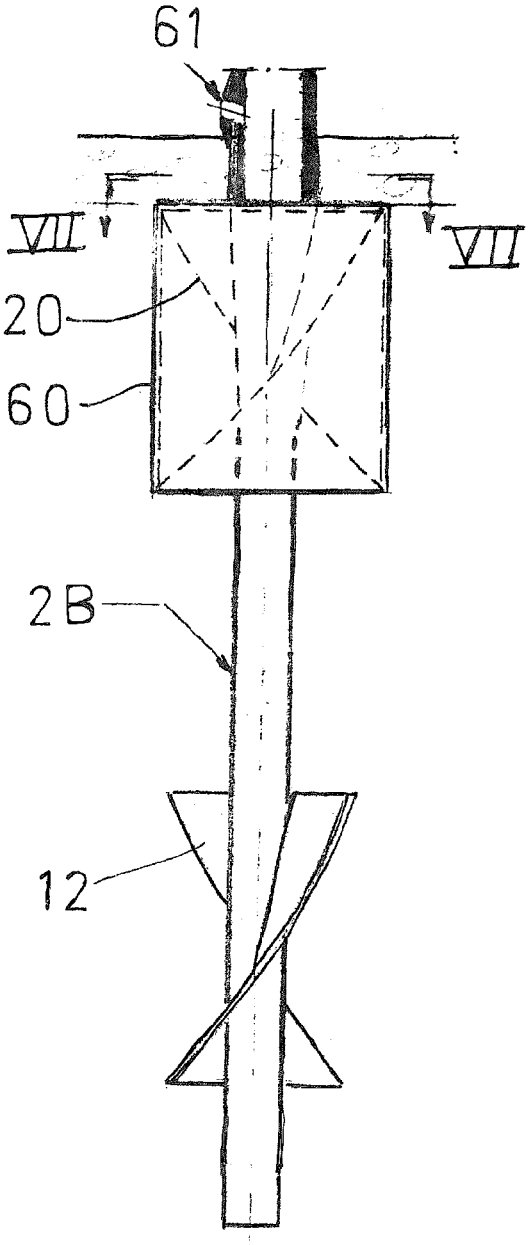
Figure 7:
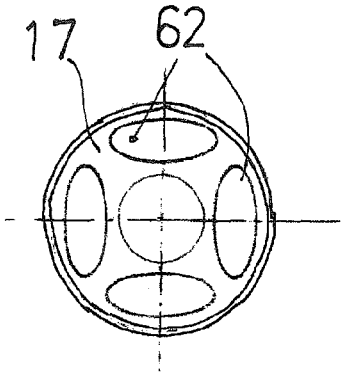
Figure 8:
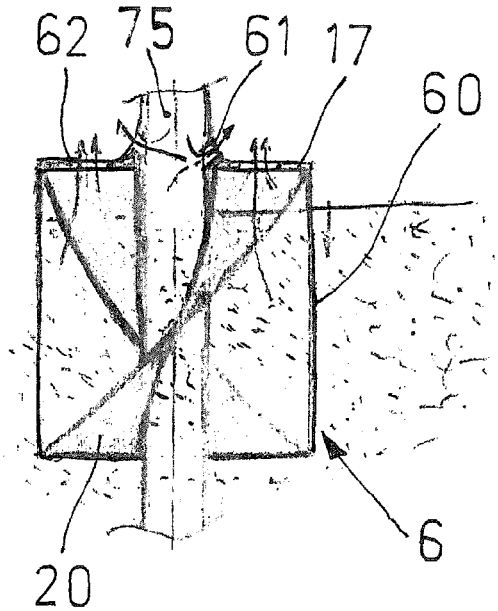
Figure 9:
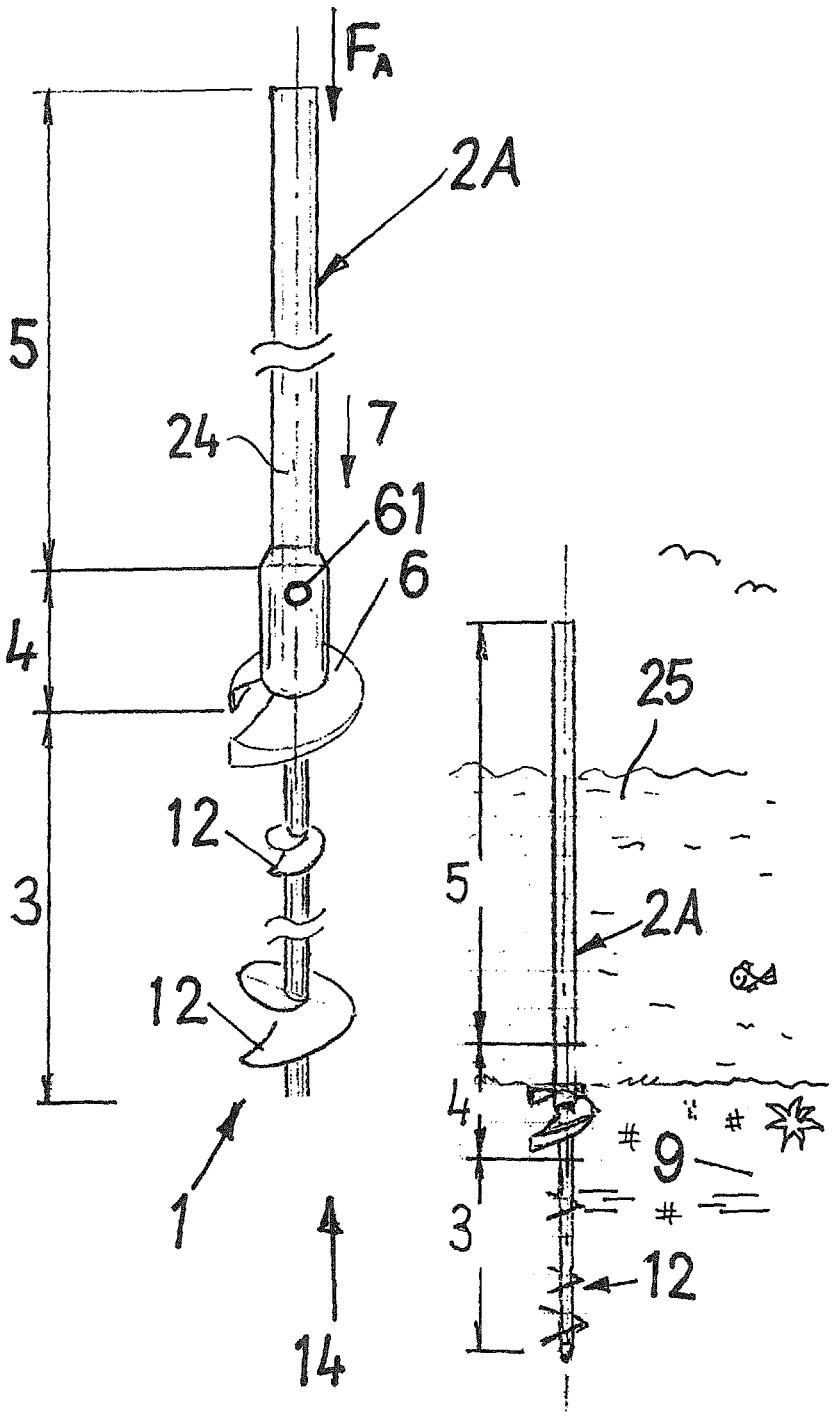
Figure 10:
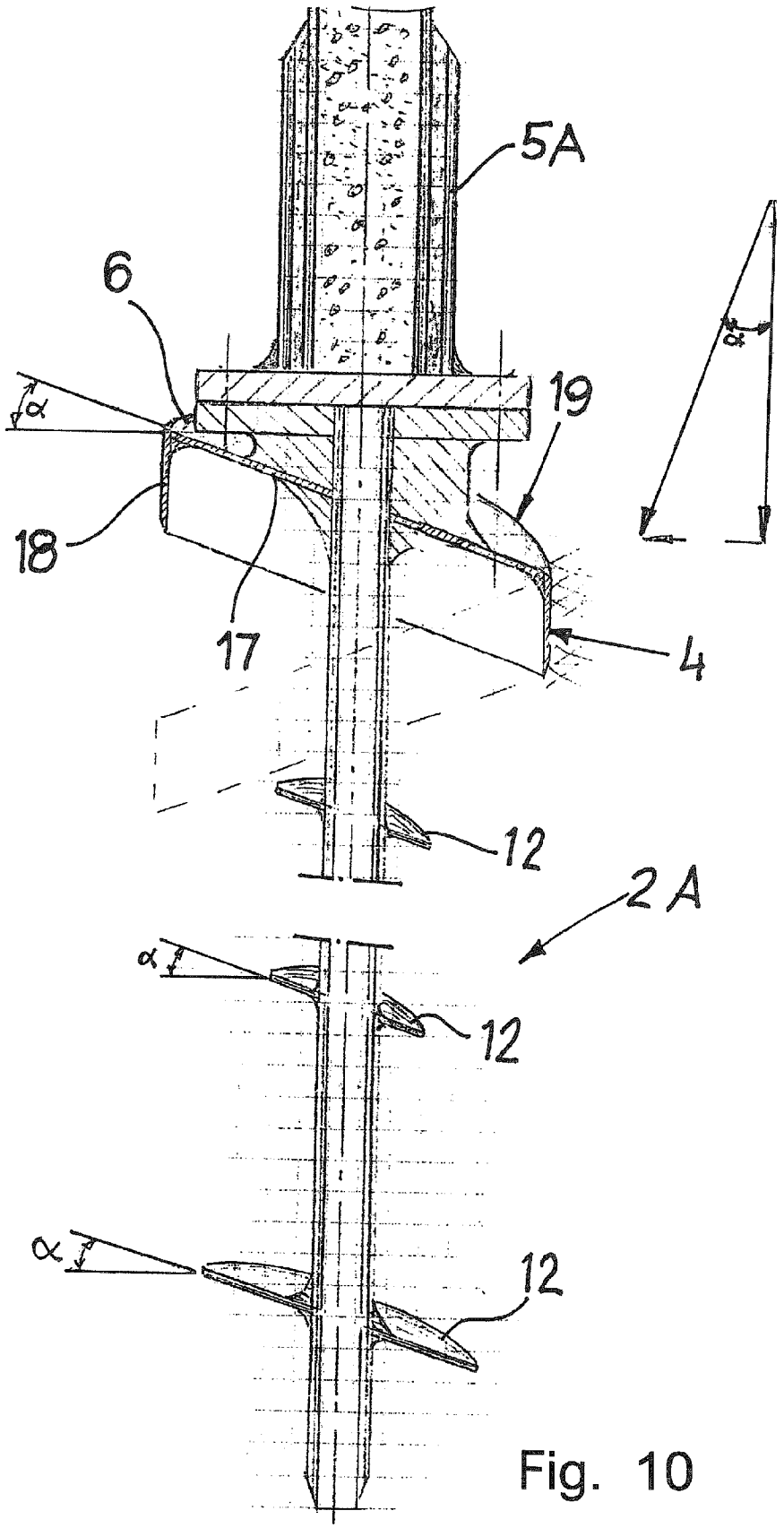
Figure 11:
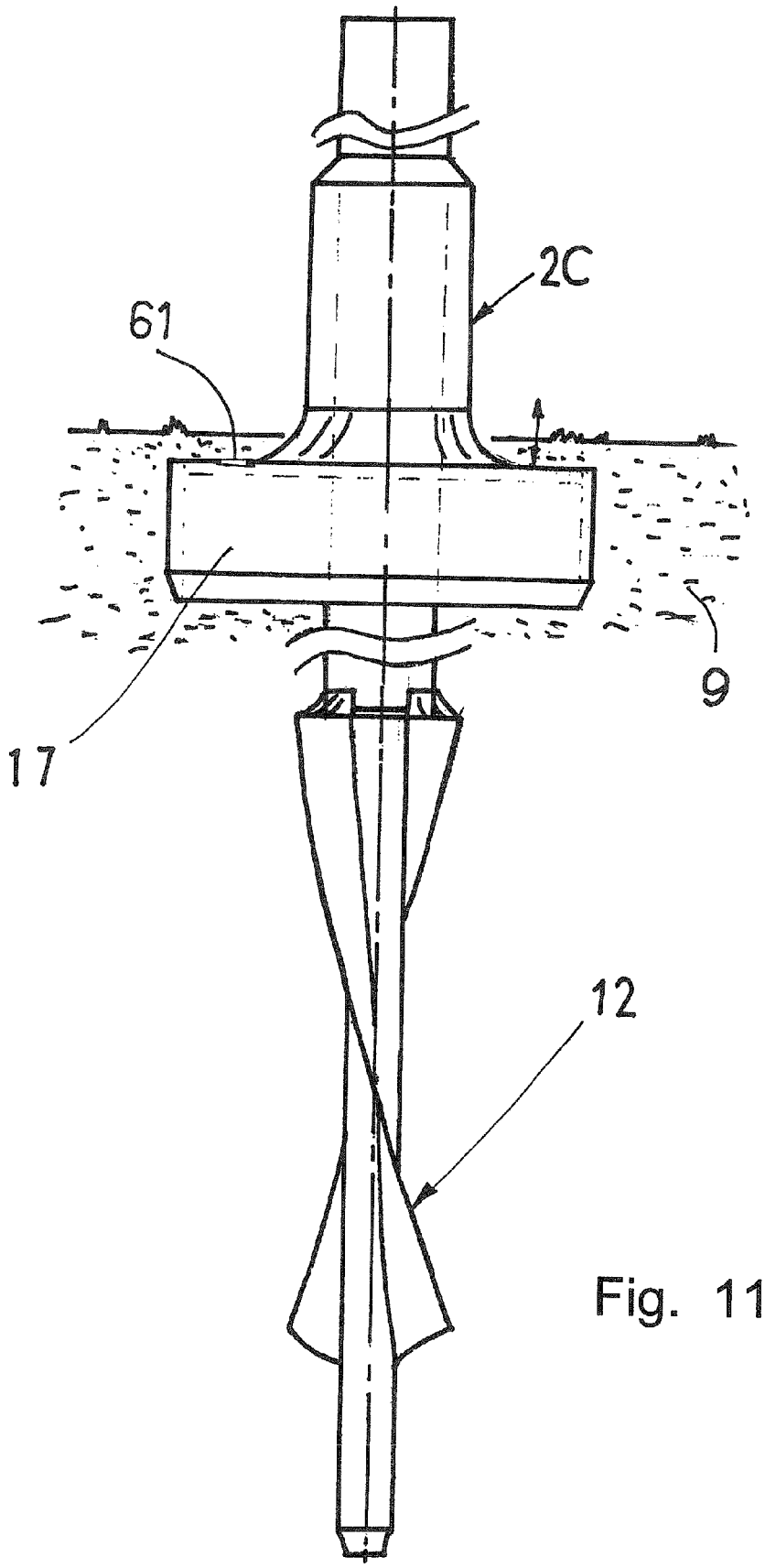
Figure 12:
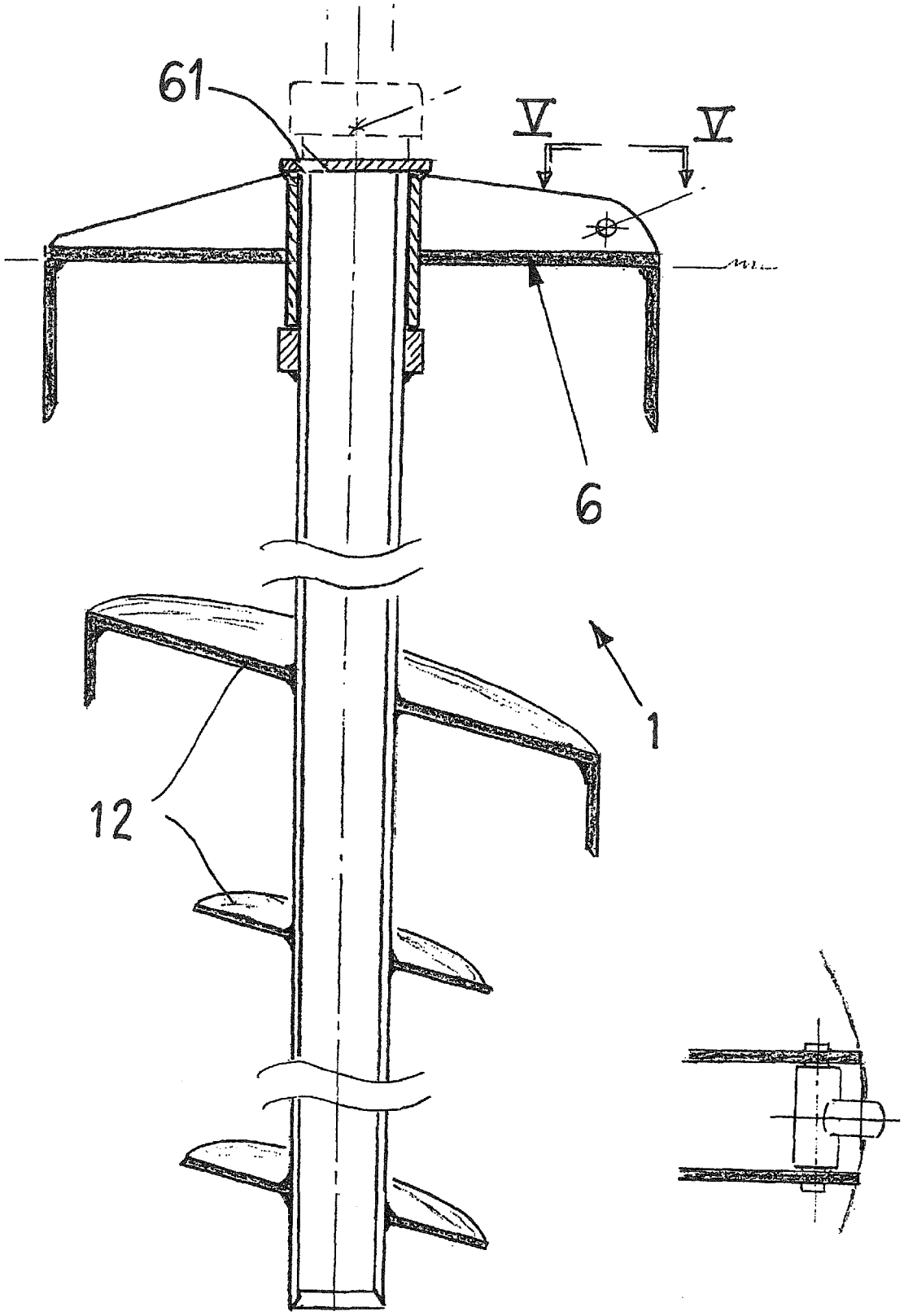
Figure 13:
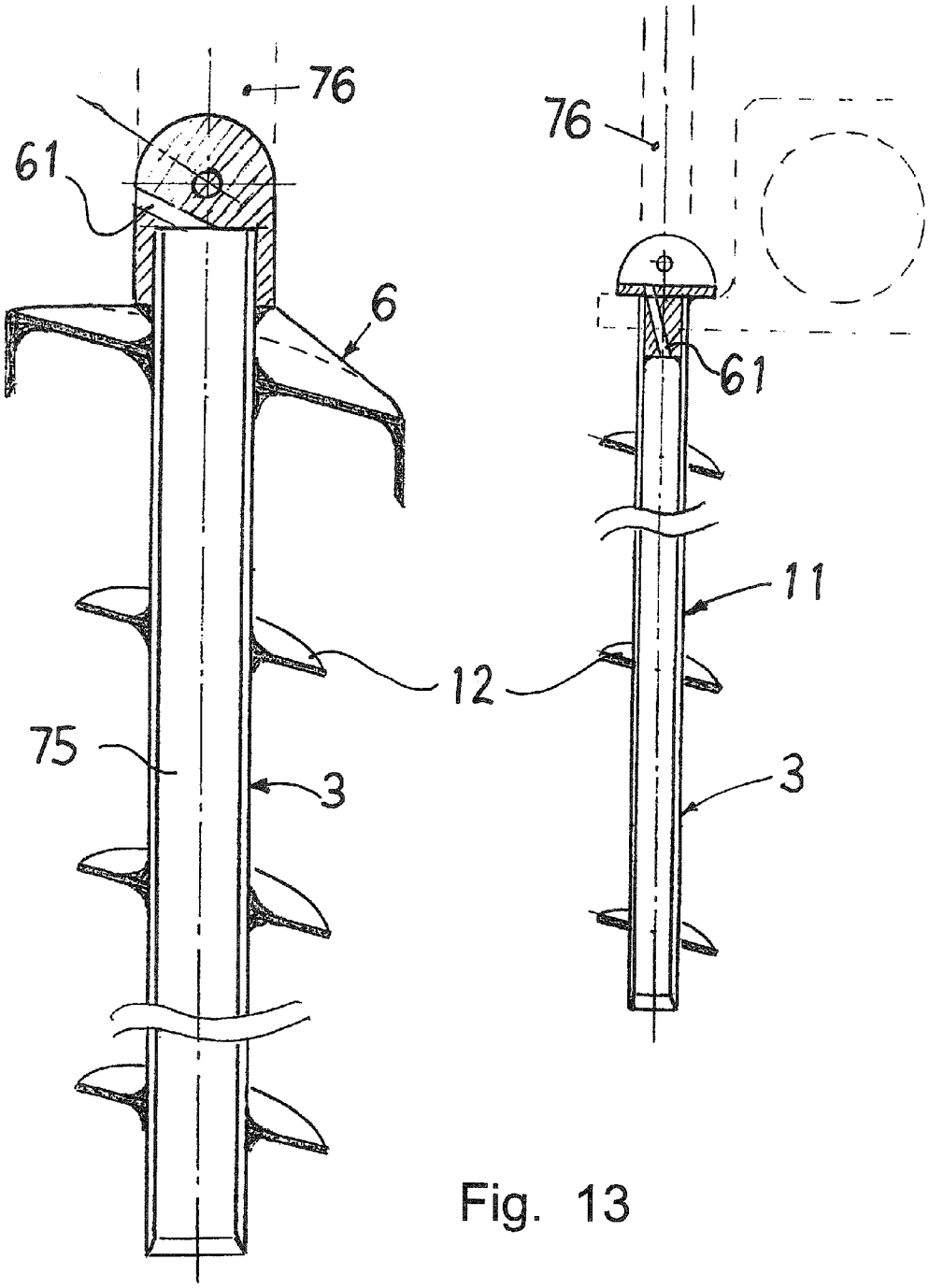
Figures 14, 15:
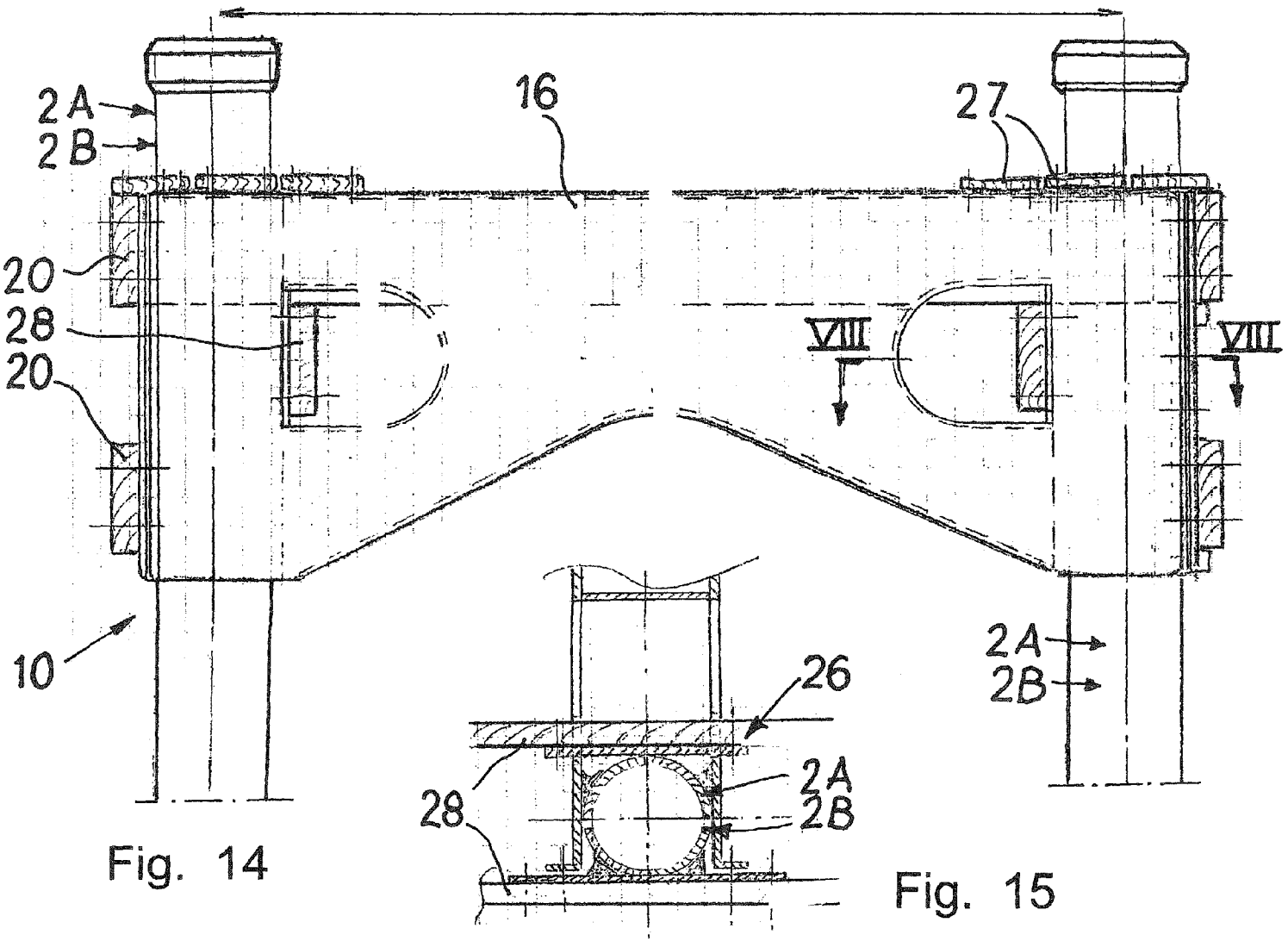
Figure 16:
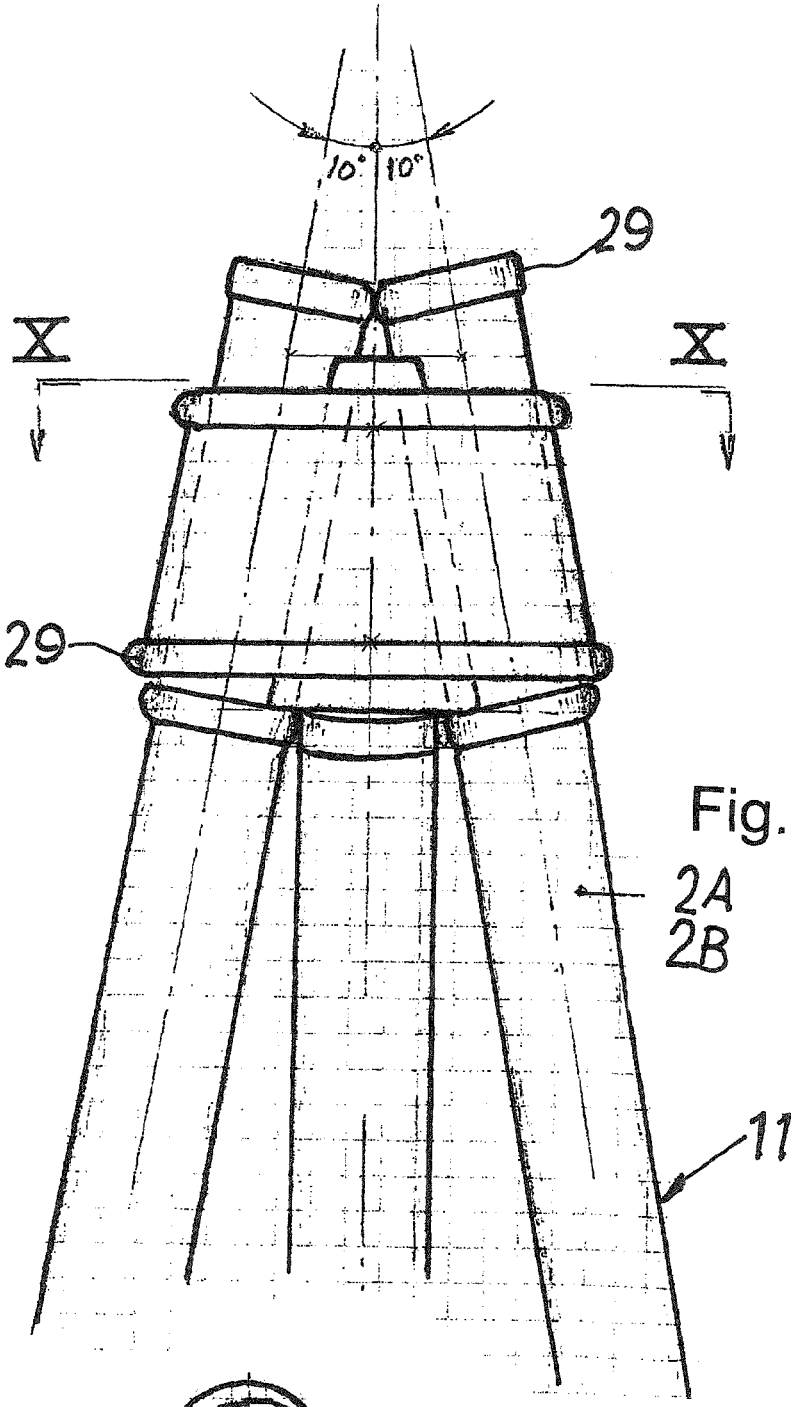
Figure 17:
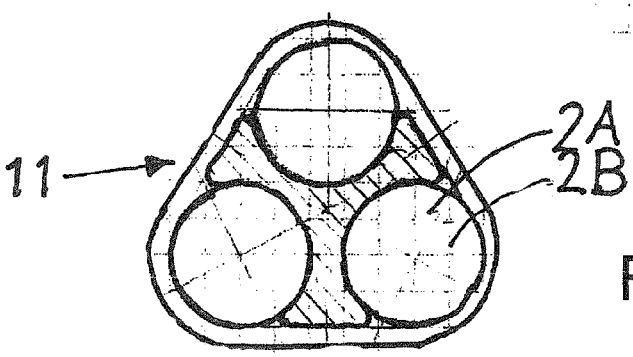
Figure 18:
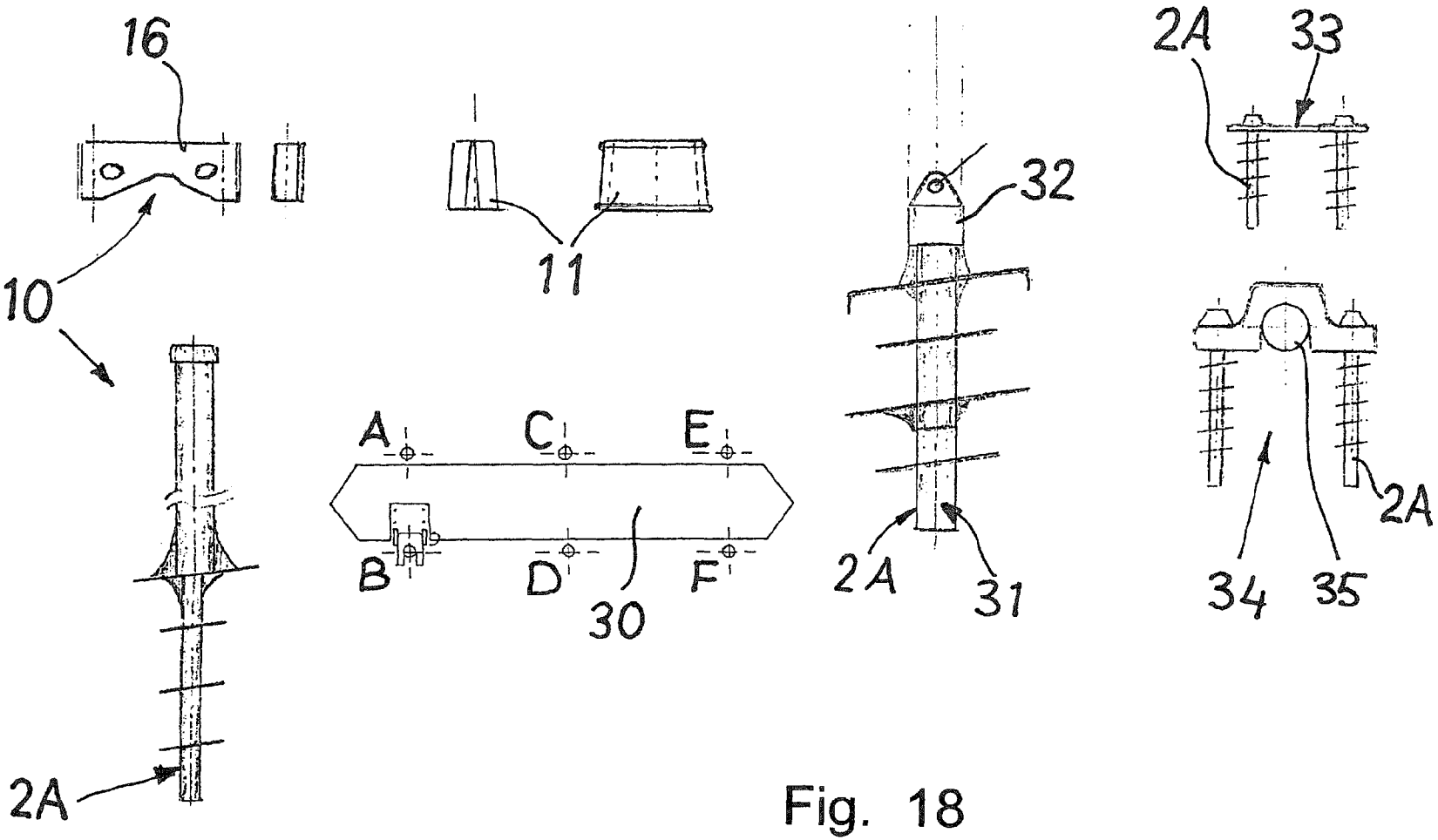

The invention is described in the following as a number of preferred embodiments with reference to the accompanying drawings, in which FIG. 1 is a schematic perspective view of screw piles adapted to support a bridge, FIG. 2 illustrates force transmitting parts at screw piles arranged in pairs when applied in the bottom of a lake, FIG. 3 is a sectional view of said bridge with piles arranged in pairs, FIG. 4 is a sectional view of screw piles, FIG. 5 is a partial sectional view of a push pile according to the invention, FIG. 6 is a cross sectional view of the push pile along a portion of its length, FIG. 7 is a sectional view along the line XII-XII in FIG. 6, FIG. 8 is a sectional view of the force transmitting part of said push pile, FIG. 9 is a perspective view of a screw pile and a lateral view of said screw pile when applied in the bottom of a lake, FIG. 10 is a sectional view of a screw pile, FIG. 11 is a lateral view of a push pile according to the invention in applied state, FIG. 12 is a cross sectional view of the push pile and a sectional view of attachment along the line V-V in the same figure, FIG. 13 are longitudinal sectional views of variants of anchoring piles, FIG. 14 illustrates piles with parallel struts with attachment, FIG. 15 is a sectional view along the line VIII-VIII in FIG. 14, FIG. 16 is a lateral view of a group of mooring piles ("vrage"), FIG. 17 is a sectional view along the line X-X in FIG. 16, and FIG. 18 illustrates various applications of the present invention with accessories for the purposes.

The various embodiments of the piles have been designed to be optimally adapted to different bottom conditions. As an example FIG. 10 illustrates a pile adapted to great depths in a muddy bottom, where long piles are required, while the pile shown in FIG. 11 is especially suitable to use in moraine bottom.

A device 1 for a pile 2A, 2B, which can be anchored in the bottom of a lake or the sea and/or the ground and which is of the screw and/or push type and which exhibits at least a front part 3, but preferably also an intermediate part 4 and an upper part 5, comprises a pile 2A, 2B, which consists of plastic material, preferably of re-usable and non-polluting plastic material, or of steel or concrete. Between said front part 3 and upper part 5 a force transmitting part 6 is arranged. This force transmitting part 6 is designed to make it possible to transmit downwards directed 7 axial forces $F_A$ and laterally 8 directed horizontal forces $F_H$ to the bottom or ground segment 9 in question.

A screw pile 2A, which is hollow and made of plastic, for example, and which is built up round a support consisting of a plastic pipe and with a desired number of layers of glass fibre reinforced plastic applied on the outside of this support and painted on the outside, is principally intended and arranged to be used for building up bridges 10 and for mooring piles 11 in a rough environment, where worm infestation, environmental effects or ice are problems when wooden piles or other types of piles were used previously. Preferably, the pile 2A, 2B is prefabricated, adapted and ready to be used at the site in question, for example a building site, and it is easy to apply and handle, as it, preferably, has low weight.

Properties of said pile are among other things:

- It is made of plastic, which is easy to work with, non-polluting and re-usable, or of concrete or steel or other metal.
- It is possible to easily and without using much force screw and/or push it into the bottom segment in question in lake, sea 25 or ground.
- It can easily be removed and re-used.
- It is possible to adjust it vertically in case of settling or if it desirable to change the height conditions.
- It has unique capacity to resist vertical and horizontal forces and to transmit these forces to the bottom segment.

Advantages of said pile are among other things:

- Low weight.
- High shock resistance and load endurance.
- Insensitive to worm infestation, decay and corrosion.
- Fast and simple application.
- Comparatively low cost of production of advanced design.
- Ecofriendly (working environment, water environment).
- Long life and good economy.
- Not destroyed (collapsed) bottom segment when the piles are driven down, so that the piles "cut" down through the segment.
- Re-usable—adjustable.
- High force transmitting capacity.
- Low driving down force.

The screw pile 2A may be supplemented with products, such as parallel struts, attachments etc. to build bridges completely and rationally in order to absorb transverse forces, and attachment for latches and decks, and where the strength properties of the materials are used in an optimal way. The purpose of the pile is that it shall be superior to the piles existing today with regard to environmental aspects, length of life, resistance and economy.

Said force transmitting part 6 can be formed of a substantially horizontal or inclined disc-shaped part 17 with substantially vertically extending flange 18 directed towards said front part 3, preferably arranged at the outer peripheral edge 19 of the disc-shaped part 17. Suitably, said force transmitting part 6 is formed of a portion of a thread 20 along the pile 2A, which force transmitting part 6 extends approximately one turn round the pile 2A.

Such a screw pile 2A may exhibit a force transmitting part 6, which, in addition to a helical thread 20, which is firmly connected to the pile 2A and which extends at least one turn round the pile 2A, supports a cylinder-shaped part 60, which extends in the longitudinal direction 14 of said thread 20 and completely round said thread 20. Said part 60 may be completely open at the top as well as at the bottom, but suitably a substantially horizontal upper disc 17 is arranged to close the main portion of said cylinder-shaped force transmitting part 6 in the upwards direction 14.

The pile 2A, 2B with its tubular front part 3 is open in direction downwards, at least up to a said thread-shaped force transmitting part 6, so that ground/bottom material can be pressed into and received therein when the pile 2A, 2B is screwed or pushed, respectively, into the ground/bottom 9. Above said part 60 the force transmitting part 6 and the pile 2 are provided with a number of apertures 62, 61 for the evacuation of air and water when driving down the pile 2, and in order to prevent the blasting effect in case of ice formation inside the pile. Thus, the front part 3 of the pile is tubular, whereby the pile 2A, 2B exhibits a number of evacuation apertures 61, which, besides functioning as pressure reduction aperture in case of ice formation inside the pile and thereby eliminating the blasting effect of the tubular pile 2B, also discharge water and air from the inner space 75 of the pile. These apertures 61 debouch from the upper portion 3A of the front part 3 in the region of an intermediate part 4 of a pile 2A, 2B into the surroundings. Preferably, said threaded pile 2A exhibits a flat peripheral surface 24 above the level of said thread-shaped force transmitting part 6, which is suitable for connection purposes. In the first place said pile 2A, 2B is adapted to be used for the erection of bridges 10, but also as anchoring pile 11 in water 25, and it is arranged to be screwed and/or pushed into the bottom material 9. The screwing and/or pushing can be effected by means of a removable tool 76, which is disconnected when the desired driving down has been achieved.

Preferably, the part 3 of the pile 2, which transmits force to the bottom segment, has a constant length, for example always 3.5 m. The upper part 5 of the pile is adapted to the depth of water, loose segment and purpose of use. Specially adapted piles can be made if required.

By means of an especially developed calculation program and tests carried out, the piles are dimensioned according to stipulated criteria of stress and strain. The piles may be tested in a special test rig in order to assure that the stipulated criteria are fulfilled.

The pile 2B illustrated in FIGS. 5-8 is particularly intended to be used as a so called push pile, i.e. it is pushed into the bedding by a vertical force F in the upper part of the pile, whereby threads 20, 12 having a large pitch in a common direction are fastened to the pile 2B along its outer peripheral surface.

The function of the different parts, the front part 3, the intermediate part 4 and the upper part 5, of said pile 2A, 2B is as follows: The front part 3 exhibits means in the form of threads 12, 20 or an enlarged driving part 13 at screw pile 2A and push pile 2B, respectively, in order to drive down the pile 2A, 2B and anchor it against substantially axial drawing forces in the upwards direction 14.

The intermediate part 4, which constitutes a stiffening part of the pile 2A, 2B, exhibits a force transmitting part 6 in order to be capable of transmitting downwards directed axial forces $F_A$ and lateral forces $F_H$ to the bottom segment 9 in an optimal way. Hereby, the pile 2A, 2B is prevented from moving horizontally, which eliminates the risk of the pile 2A, 2B breaking the bottom segment 9, and in that way looses its lateral stability, i.e. becomes wobbly. At the same time lateral forces are prevented from generating axial forces and cause settling.

In this part of the pile there is also an aperture 61 for the evacuation of air and water, which makes it possible to convey the bottom segment upwards into section 1 in the inner space 75 thereof without being destroyed when the pile is driven down. Hereby a not destroyed (collapsed) bottom segment at the point of the pile is obtained.

The upper part 5 is arranged and designed as a flexible part in order to permit the pile 2A, 2B to absorb lateral forces by reducing said forces and absorbing them, and by reducing thrusts.

FIG. 10 illustrates a screw pile 2A exhibiting a screw with threads 12 with desired pitch $\alpha$, and which absorbs drawing and compressive forces, while its force transmitting part 6, in the form of a transitional thread, consolidates the pile 2A against bending, seals, absorbs compressive and lateral forces.

In the inner space of the pile 2B a reinforcement in the form of an additional tubular layer may be arranged, which strengthens the pile against breaking forces when it is driven into the material of the bedding.

The top of the upper part 5 is formed of a cap 15, which is provided with key handles in order to constitute a grip when the pile 2A is screwed downwards and upwards, respectively.

A pile 2A, 2B can be divided into the following zones:

A lower fastening part I intended to keep the pile 2A, 2B straight when it is driven into the bedding.

A driving part II provided with a screw thread 12, 71 with normal or large pitch in order to absorb particularly upwards directed axial forces, and which causes rotation when the pile 2B is driven down into the bedding and lifted up from it, respectively, and which eliminates "ice grip" caused by torsional and axial forces.

A force transmitting part III in the form of a disc with flange or a screw thread with normal or large pitch, and which is provided with a cylinder attached on the outside for the absorption of vertical and lateral forces. A flexible part, which is manufactured in accordance with desired rigidity and length.

The piles illustrated in FIGS. 11-13 are combined push and screw piles, the function of which is clearly evident. They are particularly suitable to use when the piles are to be driven down by pushing them into a sandy bottom 9, where the threaded portion 12 of the pile effects the driving down of the pile after it has been pushed into the bottom material 9. The force transmitting part 17 of the pile, which is a disc-shaped part according to the type described above, effects stiffening of the pile when said part 17 has been pushed down into the bottom material 9 in question.

The disc-shaped force transmitting part 17 can also be loose and threaded on to the pile 2, and when the pile has been driven into the bottom bedding 9, for example moraine or firm mud, said force transmitting part is pushed into said bedding after having been threaded on to the pile 2. Then, said force transmitting part 17 with its peripheral part pushed into the bedding 9 supports the pile effectively.

FIG. 12-13 illustrate anchoring piles provided with threads and force transmitting part.

FIG. 14 illustrates a parallel strut 16 with attachments 26 for the same on the piles 2A, 2B. On top of said parallel strut 16 a deck 27, for example for a bridge, can be anchored, and latches 28 are connected laterally. FIG. 15 illustrates locking of pairs of piles to parallel strut.

FIGS. 16-17 illustrate the invention applied at a group of mooring piles ("vrage") 11 with a desired number of angularly arranged piles 2A, 2B and enclosing connection 29, in the form of strut ("kornstag") and attachment ("kornfäste"), which effectively fixes and locks the piles and makes them co-operate with one another. Thereby an example of locking of co-operating piles is shown.

In FIG. 18 the bridge building assembly and the assembly for building a group of anchoring piles described above are shown. Furthermore, an appropriate floatable appliance is illustrated in the form of barge fixture 30 with six illustrated fixture positions A-F for the anchorage of piles in desired places. Further, the invention can relate to an anchor pile 31 with an anchorage attachment 32 arranged at the top.

Finally, it can be mentioned that the invention may be applied as anchorage for foundation 33 or anchorage 34 of pipe 35 or as any other suitable anchorage.

The nature and the function of the invention should have been clearly understood on the basis of the above description and the drawings.

Of course, the invention is not limited to the embodiments described above and illustrated in the accompanying drawings. Modifications are possible, especially as far as the nature of the different parts is concerned, or by using equivalent technique, without departing from the scope of the invention as it is defined in the patent claims.

The invention claimed is:

1. A device for a pile anchorable in a lake bottom or sea bottom or a ground and of a screw type or push type, the device comprising:

a force-transmitting part arranged between an upper part of the pile and an upper portion of a front tubular part of the pile, the force-transmitting part comprising:

a threaded portion along the pile that has at least approximately one turn of thread around the pile, with a cylinder-shaped part extending in a longitudinal direction of the thread and completely around the thread, wherein the upper portion of the front tubular part includes a number of apertures for debouching water or air, the force-transmitting part is configured for transmitting downwardly directed axial forces and laterally directed horizontal forces to the lake- or sea-bottom or ground, the front tubular part includes a thread, and the thread of the threaded portion and the thread of the front tubular part have a common pitch direction.

2. The device of claim 1, wherein at least a front portion of the front tubular part of the pile has a number of threads, and threads of the front portion of the front tubular part have a pitch that is the same as the thread of the threaded portion.

3. The device of claim 1, wherein the pile includes a flat peripheral surface above the threaded portion.

4. The device of claim 1, wherein the threaded portion includes a substantially horizontal upper disk that closes a main portion of the cylinder-shaped part in an upward direction.

5. The device of claim 4, wherein the cylinder-shaped part includes a grooved lower edge.

6. The device of claim 4, wherein the substantially horizontal upper disk is connected to the front tubular part and to the force-transmitting part.

7. The device of claim 1, wherein the cylinder-shaped part is connected to the threaded portion along a periphery of the threaded portion.

8. The device of claim 1, wherein the pile is cone-shaped with upward taper.

9. The device of claim 1, wherein the pile is made of plastic.

10. A device for a pile anchorable in a lake bottom or sea bottom or a ground and of a screw type or push type, the device comprising:

a force-transmitting part arranged between an upper part of the pile and an upper portion of a front tubular part of the pile, the force-transmitting part comprising:

a threaded portion along the pile that has at least approximately one turn of thread around the pile, with a cylinder-shaped part extending in a longitudinal direction of the thread and completely around the thread, and a substantially horizontal upper disk that closes a main portion of the cylinder-shaped part in an upward direction wherein the upper portion of the front tubular part includes a number of apertures for debouching water or air, the force-transmitting part is configured for transmitting downwardly directed axial forces and laterally directed horizontal forces to the lake- or sea-bottom or ground, and the cylinder-shaped part includes a grooved lower edge.

11. The device of claim 10, wherein the substantially horizontal upper disk is connected to the front tubular part and to the force-transmitting part.

* * * * *